US005545972A

United States Patent [19]

Kiehl

[11] Patent Number: 5,545,972

[45] Date of Patent: Aug. 13, 1996

[54] CURRENT MIRROR

[75] Inventor: Oliver Kiehl, Munich, Germany

[73] Assignee: Siemens Aktiengesellschaft, Munich, Germany

[21] Appl. No.: 301,868

[22] Filed: Sep. 6, 1994

[30] Foreign Application Priority Data

Sep. 3, 1993 [DE] Germany ..... 43 29 867.2

[51] Int. Cl.[6] ..... G05F 3/16

[52] U.S. Cl. ..... 323/315; 323/316

[58] Field of Search ..... 323/315, 316, 323/317

[56] References Cited

U.S. PATENT DOCUMENTS

| | | | |
|---|---|---|---|
| 4,477,782 | 10/1984 | Swanson | 330/228 |
| 4,618,815 | 10/1986 | Swanson | 323/315 |
| 4,983,929 | 1/1991 | Real et al. | 330/288 |

FOREIGN PATENT DOCUMENTS

| | | |
|---|---|---|
| 2840740 | 1/1983 | Germany . |
| 2034939 | 6/1980 | United Kingdom . |

OTHER PUBLICATIONS

Book: "Halnlriyrt–Schaltungstechnik [Semiconductor Circuitry]" (Tietze and Schenk), 8th Edition 1986, pp. 62–64 and 94–97.

*Primary Examiner*—Peter S. Wong
*Assistant Examiner*—Shawn Riley
*Attorney, Agent, or Firm*—Herbert L. Lerner; Laurence A. Greenberg

[57] ABSTRACT

A current mirror includes first and second transistors each having a control terminal and a load path with two terminals. The control terminals of the first and second transistors and one of the terminals of the load path of the first transistor receive a first input current. Third, fourth and fifth transistors each have a control terminal and a load path with two terminals. The control terminals of the third, fourth and fifth transistors and one of the terminals of the load path of the third transistor receive a second input current of equal magnitude to the first input current. One of the terminals of the load path of the fifth transistor supplies an output current proportional to the two input currents. The other of the terminals of the load paths of the third and fifth transistors are each connected to one terminal of the load path of a respective one of the fourth and second transistors. The other of the terminals of the load paths of the first, second and fourth transistors are connected to a common reference point.

9 Claims, 1 Drawing Sheet

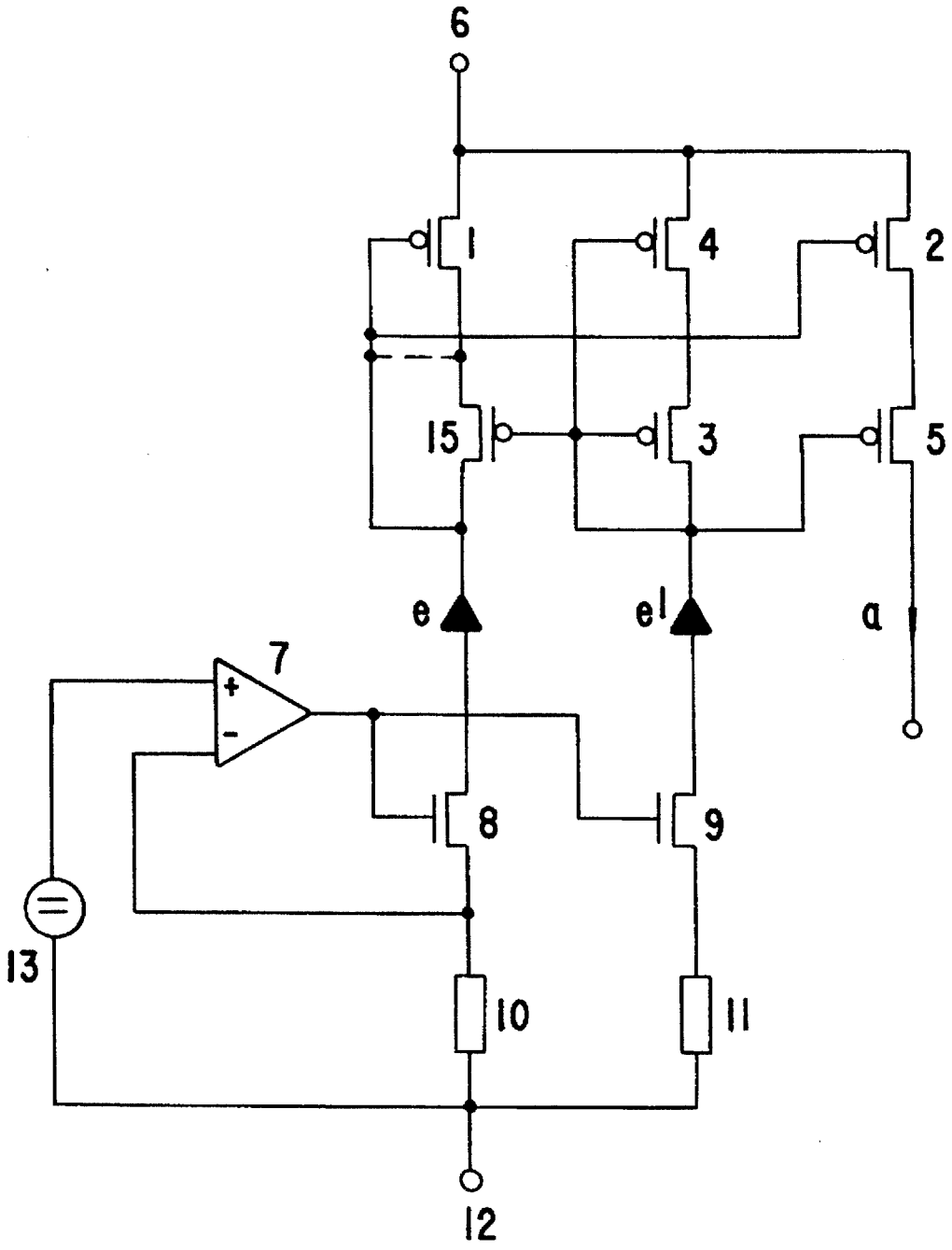
6
1
4
2
15
3
5
e
e'
a
7
+
-
8
9
13
10
11
12

CURRENT MIRROR

FIELD OF THE INVENTION

The invention relates to a current mirror.

BACKGROUND OF THE INVENTION

Various embodiments of current mirrors are known from the book entitled "Halbleiter-Schaltungstechnik" [Semiconductor Circuitry] by Tietze and Schenk, 8th Edition 1986, pp. 62–64 and 94–97. Current mirrors are asked to meet three demands, yet meeting all three at once is difficult to achieve. The first and second are high accuracy and low expenditure for circuitry. In addition, the voltage drop in the input branch and output branch of the current mirror should be as slight as possible. However, precise current mirrors with a slight voltage drop can be achieved only at considerable expenditure for circuitry. Conversely, less expensive current mirrors are either relatively inaccurate or produce a high voltage drop.

An MOS-integrated constant current source is also known from German Patent DE 28 40 740 C2, corresponding to Published UK Application GB 2 034 939 A. FIG. 2 of that patent shows a circuit made up of MOS transistors, in which the dependency of the output current on the output voltage is reduced.

SUMMARY OF THE INVENTION

It is accordingly an object of the invention to provide a current mirror, which overcomes the hereinafore-mentioned disadvantages of the heretofore-known devices of this general type and which has high accuracy, a slight voltage drop, and a low expenditure for circuitry.

With the foregoing and other objects in view there is provided, in accordance with the invention, a current mirror, comprising first and second transistors each having a control terminal and a load path with two terminals, the control terminals of the first and second transistors and one of the terminals of the load path of the first transistor receiving a first input current; third, fourth and fifth transistors each having a control terminal and a load path with two terminals, the control terminals of the third, fourth and fifth transistors and one of the terminals of the load path of the third transistor receiving a second input current of equal magnitude to the first input current; one of the terminals of the load path of the fifth transistor supplying an output current proportional to the two input currents; the other of the terminals of the load paths of the third and fifth transistors each being connected to one terminal of the load path of a respective one of the fourth and second transistors; and the other of the terminals of the load paths of the first, second and fourth transistors being connected to a common reference point.

In accordance with another feature of the invention, the first input current is carried to the drain terminal of the first transistor through a load path of a sixth transistor having a control terminal which is connected to the control terminals of the third, fourth and fifth transistors.

The current mirror according to the invention can be made either with bipolar transistors or with MOS field effect transistors. However, in accordance with a further feature of the invention, MOS field effect transistors are exclusively provided, and the ratio between the channel width and channel length of the fourth transistor is equal to one-third of the ratio between the channel width and the channel length of the first and second transistors.

In accordance with an added feature of the invention, the first and second transistors on one hand, and the third and fifth transistors on the other hand, are constructed identically.

In accordance with a concomitant feature of the invention, the channel lengths of the first, second and fourth transistors are the same as one another, and the channel lengths of the third and fifth transistors are the same as one another.

Other features which are considered as characteristic for the invention are set forth in the appended claims.

Although the invention is illustrated and described herein as embodied in a current mirror, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE of the drawing is a schematic circuit diagram of an exemplary embodiment of the invention.

DESCRIPTION OF THE PREFERRED EMBODIMENTS

Referring now to the single FIGURE of the drawing in detail, there is seen an exemplary embodiment of a current mirror in which an input current e is carried, for instance, to gate terminals of a transistor 1 and a transistor 2. In addition, according to a further feature of the invention, an MOS field effect transistor 15 of the p-channel type which is provided in the exemplary embodiment, has a source terminal connected to a drain terminal of the transistor 1. The input current e is carried to a drain terminal of the transistor 15 and to the gate terminal of the transistor 1. A further input current e', which is of equal magnitude to the input current e, is carried to gate terminals of a transistor 3, a transistor 4, a transistor 5 and the transistor 15, as well as to a drain terminal of the transistor 3. Source terminals of the transistors 3 and 5 are each connected to a drain terminal of a respective one of the transistors 4 and 2. The transistors 4 and 2 have source terminals which in turn, like a source terminal of the transistor 1, are connected to a supply potential 6. An output current a which is proportional to the two input currents e and e' can be picked up at a drain terminal of transistor 5, and its proportionality factor can be varied by means of a suitable choice of the width to length ratios of the transistor 2 or 5 to the transistor 1 or 3, as applicable.

The transistors that are used are MOS field effect transistors of the p-channel type. Accordingly, the supply potential 6 is positive. However, instead of MOS field effect transistors of the p-channel type, transistors of the n-channel type can be used in the same way. In either case, the ratio between the channel widths and the channel lengths for the transistor 4 is equal to one-third of the ratio between the channel widths and the channel lengths for transistors 1 and 2. Moreover, the transistors 1 and 2 on one hand, and 3, 5 and 15 on the other hand, are constructed identically, and the channel lengths for the transistors 1, 2 and 4 on one hand, and 3, 5 and 15 on the other hand, are presumed to be constructed identically. These provisions assure that the transistors 2 and 5 will be operated at the saturation limit, which increases the accuracy and minimizes the voltage drops. The voltage drops in the input circuits are reduced because only one diode threshold in each case has to be overcome. These diode thresholds are formed by the correspondingly connected transistors 1 and 3. The transistor 4 represents a controllable resistor, at which a lesser voltage drop occurs than with a diode.

If the transistor 15 should be omitted, as is indicated by a short-circuit connection shown in dashed lines, then the circuit is nevertheless still functional.

In order to produce two equal-magnitude input currents e and e', a current source with two outputs is, for instance, provided. In the exemplary embodiment, the current source includes an operational amplifier 7 having an output which is carried to gate terminals of two n-channel MOS field effect transistors 8 and 9. Source terminals of the transistors 8 and 9 are each connected through a respective resistor 10 and 11 to a negative supply potential 12. The source terminal of one of the two transistors, namely the transistor 8, is coupled to an inverting input of the operational amplifier 7. A non-inverting input of the operational amplifier 7 is connected through a reference voltage source 13 to the negative supply potential 12. The input currents e and e' for the current mirror are thus available at drain terminals of the transistors 8 and 9.

A voltage that is proportional or identical to the reference voltage then drops at a resistor 14, which is preferably constructed identically to the resistors 10, 11, when the output current a flows through it. As a result, in an integrated circuit, for instance, a reference voltage can be generated at any arbitrary point regardless of the type of supply lines.

I claim:

1. A current mirror, comprising:

first and second transistors each having a control terminal and a load path with two terminals, the control terminals of said first and second transistors and one of the terminals of the load path of said first transistor receiving a first input current;

third, fourth and fifth transistors each having a control terminal and a load path with two terminals, the control terminals of said third, fourth and fifth transistors and one of the terminals of the load path of said third transistor receiving a second input current of equal magnitude to the first input current;

one of the terminals of the load path of said fifth transistor supplying an output current proportional to the two input currents;

the other of the terminals of the load paths of said third and fifth transistors each being connected to one terminal of the load path of a respective one of said fourth and second transistors; and the other of the terminals of the load paths of said first, second and fourth transistors being connected to a common reference point.

2. The current mirror according to claim 1, including a sixth transistor having a control terminal being connected to the control terminals of said third, fourth and fifth transistors and having a load path, the one terminal of said first transistor being a drain terminal receiving the first input current through the load path of said sixth transistor.

3. The current mirror according to claim 1, wherein all of said transistors are field effect transistors, and a ratio between a channel width and a channel length of said fourth transistor is equal to one-third of a ratio between a channel width and a channel length of said third transistor.

4. The current mirror according to claim 2, wherein all of said transistors are field effect transistors, and a ratio between a channel width and a channel length of said fourth transistor is equal to one-third of a ratio between a channel width and a channel length of said third transistor.

5. The current mirror according to claim 3, wherein said first and second transistors are identical and said third and fifth transistors are identical.

6. The current mirror according to claim 4, wherein said first and second transistors are identical and said third and fifth transistors are identical.

7. The current mirror according to claim 2, wherein channel lengths of said first, second and fourth transistors are the same, and channel lengths of said third and fifth transistors are the same.

8. The current mirror according to claim 3, wherein channel lengths of said first, second and fourth transistors are the same, and channel lengths of said third and fifth transistors are the same.

9. The current mirror according to claim 4, wherein channel lengths of said first, second and fourth transistors are the same, and channel lengths of said third and fifth transistors are the same.

* * * * *